US005388692A

United States Patent [19]

Withrow et al.

[11] Patent Number: 5,388,692

[45] Date of Patent: Feb. 14, 1995

[54] LIGHTING COVER FOR A REMOTE CONTROL UNIT

[76] Inventors: Joseph E. Withrow, 20804 Rolling Meadows Dr., Pflugerville, Tex. 78660; Larry S. Gibbs, 675 Mario, Austin, Tex. 78748; Reginald Washington, 5316 Downs Dr., Austin, Tex. 78721

[21] Appl. No.: 177,077

[22] Filed: Jan. 3, 1994

[51] Int. Cl.[6] ..... B65D 85/38; B65D 85/00; F21V 33/00

[52] U.S. Cl. ..... 206/320; 206/305; 362/85; 362/109

[58] Field of Search ..... 206/305, 320; 248/172, 248/176, 187, 205.2; 362/23, 85, 86, 109

[56] References Cited

U.S. PATENT DOCUMENTS

| | | | |
|---|---|---|---|
| 4,733,776 | 3/1988 | Ward . | |
| 4,824,059 | 4/1989 | Butler . | |
| 4,836,256 | 6/1989 | Meliconi . | |
| 4,893,222 | 1/1990 | Mintzer | 362/109 |
| 4,905,127 | 2/1990 | Kaminski | 362/109 |
| 4,925,149 | 5/1990 | DiFrancesca et al. . | |
| 4,949,230 | 8/1990 | Burmeister | 362/109 |
| 5,055,977 | 10/1991 | Acquanetta | 362/23 |
| 5,063,484 | 11/1991 | Tanaka | 362/109 |
| 5,092,459 | 3/1992 | Uljanic et al. . | |
| 5,172,974 | 12/1992 | Riban | 362/109 |
| 5,183,325 | 2/1993 | Hurdle | 362/109 |
| 5,188,448 | 2/1993 | Siriani et al. | 362/109 |

*Primary Examiner*—Bryon P. Gehman

*Attorney, Agent, or Firm*—David L. Baker

[57] ABSTRACT

A protective cover for a remote control unit, having pressure responsive buttons thereon and a signal generator on one end, has a resilient housing having a housing bottom wall, two upstanding housing side walls connected to the housing bottom wall and a housing top wall connected to the housing side walls. The housing top wall has a first access viewing port and a switch port therein. There is a first closing flap, having an integral hinged connection to one end of the housing top wall, that selectively forms a first housing end wall having a first signal projection port therein. There is a second closing flap, having an integral hinged connection to another end of the housing top wall, that selectively forms a second housing end wall. A protective enclosure is removably placed within the resilient housing and has an enclosure bottom wall, two upstanding enclosure side walls connected to the enclosure bottom wall and an enclosure top wall connected to the enclosure side walls. The enclosure top wall has a second access viewing port and a switch port therein. There is a first enclosure end wall connected to the enclosure top wall and to the enclosure bottom wall. The first enclosure end wall has a second signal projection port therein. A lens port having a light dispersing lens therein extends from a light circuit chamber through an enclosure side wall and into a remote control unit chamber. There is a light circuit in the light circuit chamber that has a power source, a light or LED and a switch in the circuit.

4 Claims, 3 Drawing Sheets

LIGHTING COVER FOR A REMOTE CONTROL UNIT

BACKGROUND OF THE INVENTION

1. Field of the Invention

This invention relates to a cover for a remote control unit such as those used for a TV, video tape player/-recorder or a stereo unit. The cover reduces damage to the remote control unit from shock due to impact and enables the user to illuminate the button controls on the remote control unit.

2. Description of the Related Art

Many remote protectors available in the past were bulky and unattractive. The sole purpose of some of them was to reduce the chance of damage during shipping and they did not provide a port for the projection of a signal from the remote control unit. Previous unit did not provide a two-part unit enabling the user to not only better protect the unit but disassemble the protecting cover to aid in cleaning and replacement of the component parts of the cover for either repair or aesthetic enhancement. The present invention also provides a user a light to selectively light illuminate the button surface of the remote control unit.

U.S. Pat. No. 4,733,776 to K. Ward on Mar. 29, 1988 for a "Protective Device for a Remote Control" describes an arcuate foam cover having a transparent plastic cover to expose the face of the remote control unit. The transparent cover is attached to the foam by a hook and loop fastener.

U.S. Pat. No. 4,824,059 to L. I. Butler on Apr. 25, 1989 for a "Cushioning Device for Remote Control Television Equipment and Assembly Thereof" shows a stretchable resilient elastomeric block of natural or synthetic rubber or plastic that has a chamber therein which has an open side. There is a port on one end of the block providing access to the chamber to allow the infrared or other signal to pass through unimpeded.

U.S. Pat. No. 4,836,256 to L. Meliconi on Jun. 6, 1989 for a "Shockproof Protective Sheath for Remote Controls, in Particular Those of Television Receivers" describes a sheath to cover a remote control unit. The sheath has two openings. One to allow the unit to be placed into an inner chamber of the sheath and another to allow the signals from the remote control unit to pass from the chamber through the sheath without restriction. There is a transparent window to view the buttons on the remote control unit.

U.S. Pat. No. 4,925,149 to P. DiFrancesca on May 15, 1990 for a "Shock Absorbing Unit" shows an I-shaped structure having two opposing cups to partially encase the opposing longitudinal ends of the remote control unit.

U.S. Pat. No. 5,092,459 to D. Uljanic, et al., on Mar. 3, 1992 for a "Cover for Remote Control Unit" describes a transparent plastic case that encloses the remote control unit. The plastic case opens on one end to allow easy insertion of the remote control unit into the case. The upper face of the case has raised touch pads positioned over the buttons of the remote control unit.

SUMMARY OF THE INVENTION

A protective cover for a remote control unit, having pressure responsive buttons thereon and a signal generator on one end, is shown. The first embodiment of the protective cover has a resilient housing and a protective enclosure removably placed within the resilient housing. The resilient housing may be made from leather, vinyl or a suitable plastic or cloth either sewn, laced or heat-sealed together as is suitable for the material used. The protective enclosure is preferably made from a resilient, flexible, stretchable, expanded foam or other suitable materials. There is a light circuit chamber in the second enclosure and a light circuit in the light circuit chamber.

In a second embodiment, the protective cover for a remote control unit, having pressure responsive buttons thereon and a signal generator on one end, has a resilient housing. The resilient housing has a housing bottom wall, two upstanding housing side walls connected to the housing bottom wall and a housing top wall connected to the housing side walls. The housing top wall has a first access viewing port and a switch port therein. There is a first closing flap having an integral hinged connection to one end of the housing top wall and selectively forms a first housing end wall. The first closing flap releasably attaches to the housing bottom wall by a hook and loop fastener. A second closing flap has an integral hinged connection to another end of the housing top wall and selectively forms a second housing end wall. The second closing flap releasably attaches to the housing bottom wall by a hook and loop fastener. A protective enclosure is removably placed within the resilient housing. There is a light circuit chamber in the second enclosure and there is a light circuit in the light circuit chamber.

The light circuit may have a power source, a light (or an LED) and a switch in the circuit to selectively provide power to the light. The light circuit chamber may have a lens port extending from the light circuit chamber through an enclosure side wall and into a remote control unit chamber. The lens port may have a light dispersing lens therein.

It is an object of this invention to provide a protective cover for a remote control unit.

DESCRIPTION OF THE PREFERRED EMBODIMENTS

Figure 1:
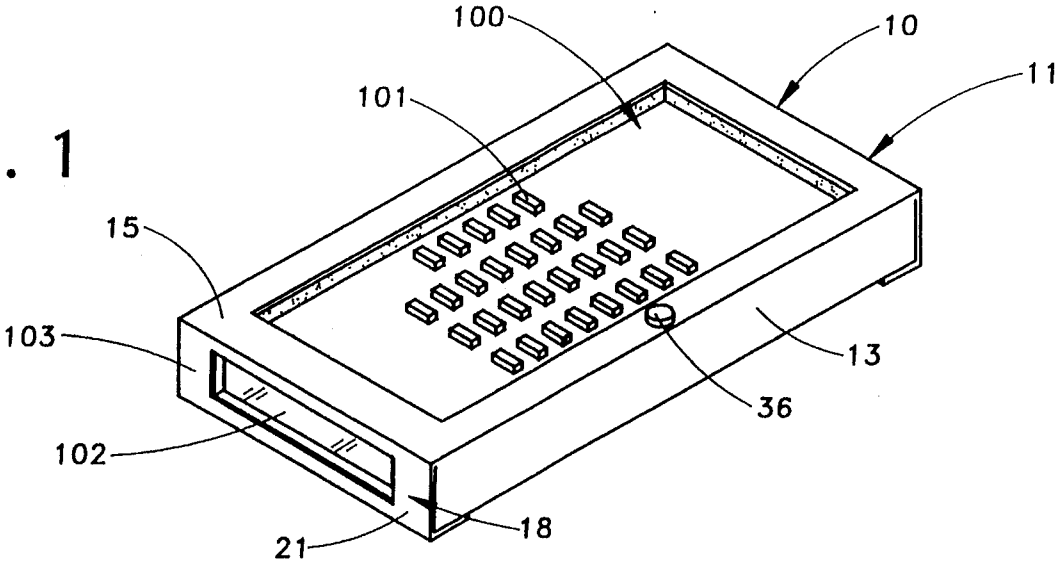
FIG. 1 is a perspective view of the Cover for a Remote Control Unit showing the remote control unit therein.
Figure 2:
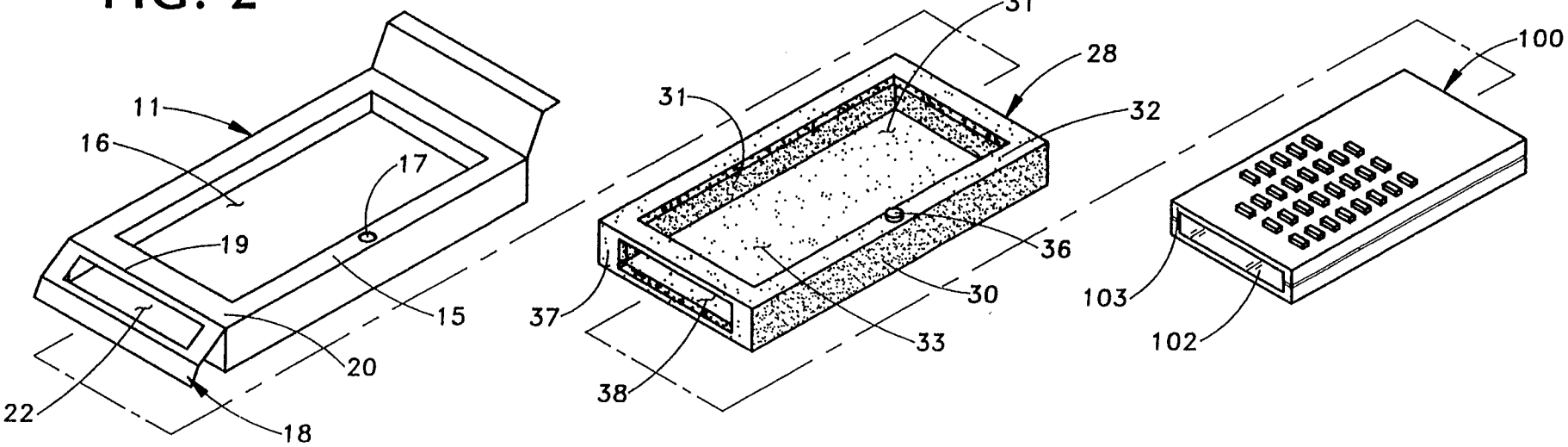
FIG. 2 is an exploded perspective view showing the assembly of the remote control unit into the protective enclosure and the placing the protective enclosure and the remote control unit within the resilient housing.
Figure 5:
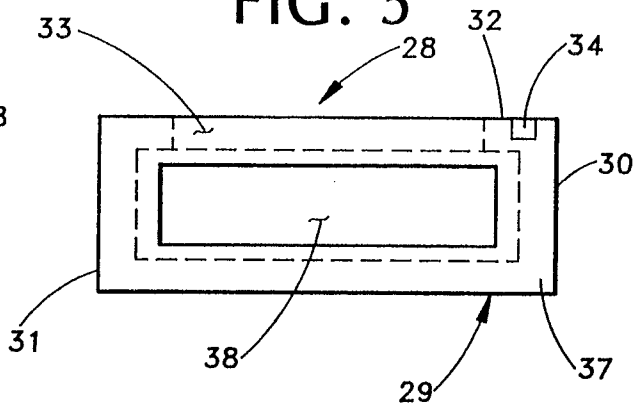
FIG. 5 is a left side elevational view of the first enclosure end wall and show the first and second signal projection ports.
Figure 6:
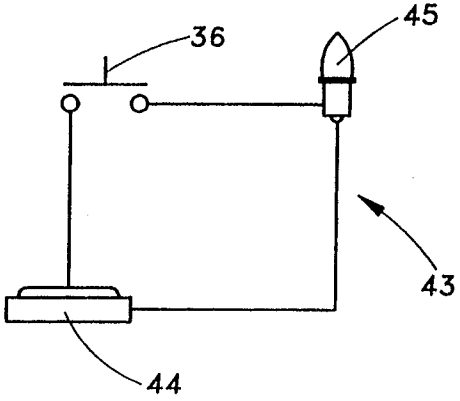
FIG. 6 is a is a diagram showing the light circuit.
Figure 3:
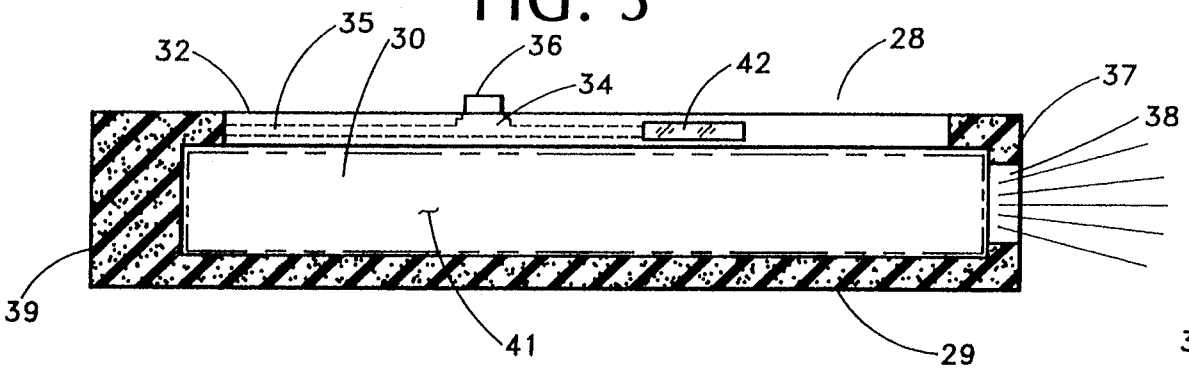
FIG. 3 is a cross-sectional view, taken along line 3—3 of FIG. 4, showing the switch extending upwards through the protective enclosure and showing the light dispersing lens. The second signal projection port is also shown with lines indicating signal departure. The remote control unit is shown in phantom.

Referring to FIGS. 1 through 8, a protective cover 10 for a remote control unit 100, having pressure responsive buttons 101 thereon and a signal generator 102 on one end 103, has a resilient housing 11. The resilient housing 11 has a housing bottom wall 12, two upstanding housing side walls 13 and 14 connected to the housing bottom wall 12 and a housing top wall 15 connected to the housing side walls 13 and 14. The housing top wall 15 has a first access viewing port 16 and a switch port 17 therein. There is a first closing flap 18 having an integral hinged connection 19 to one end 20 of the housing top wall 15 that selectively forms a first housing end wall 21. The first closing flap 18 has a first signal projection port 22 therein. The first closing flap 18 is releasably attached to the housing bottom wall 12 by a hook and loop fastener 23 such as that known under the trademark VELCRO. There is a second closing flap 24 that has an integral hinged connection 25 to another end 26 of the housing top wall 15 and selectively forms a second housing end wall 27. The second closing flap 24 is releasably attached to the housing bottom wall 12 by a hook and loop fastener 23 such as that sold under the trademark VELCRO.

Figure 4:
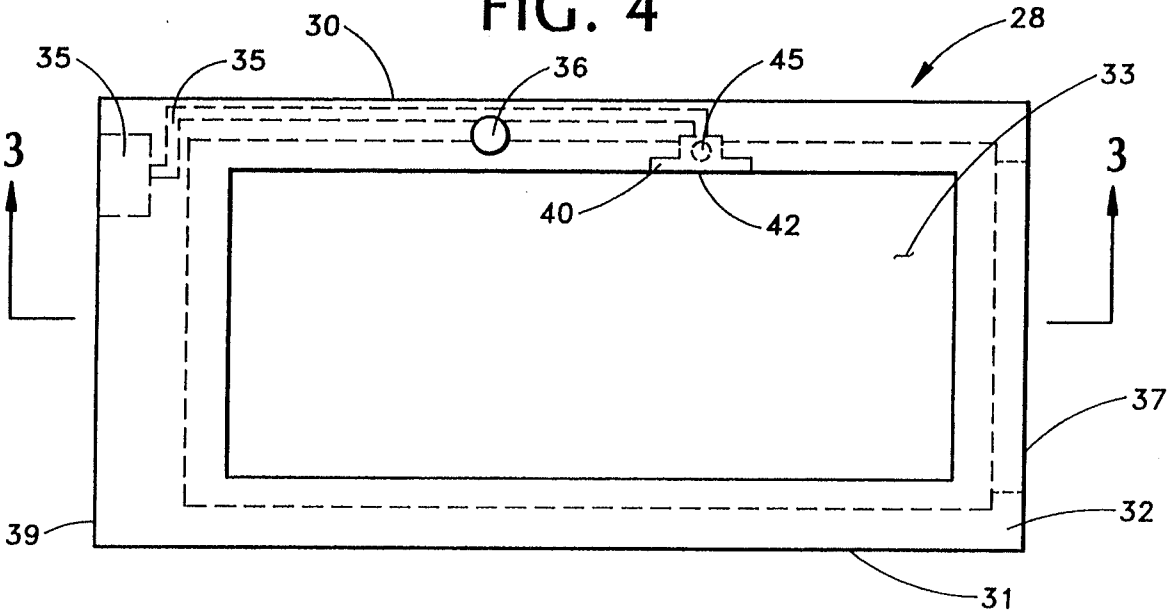
FIG. 4 is a top plan view of the protective enclosure showing the light circuit chamber and the light circuit therein in hidden lines and showing, in hidden lines, the perimeter of the second access viewing port in position under the top wall of the resilient housing. There are hidden lines showing one end of the remote control unit chamber and the sides of the second access viewing port.
Figure 7:
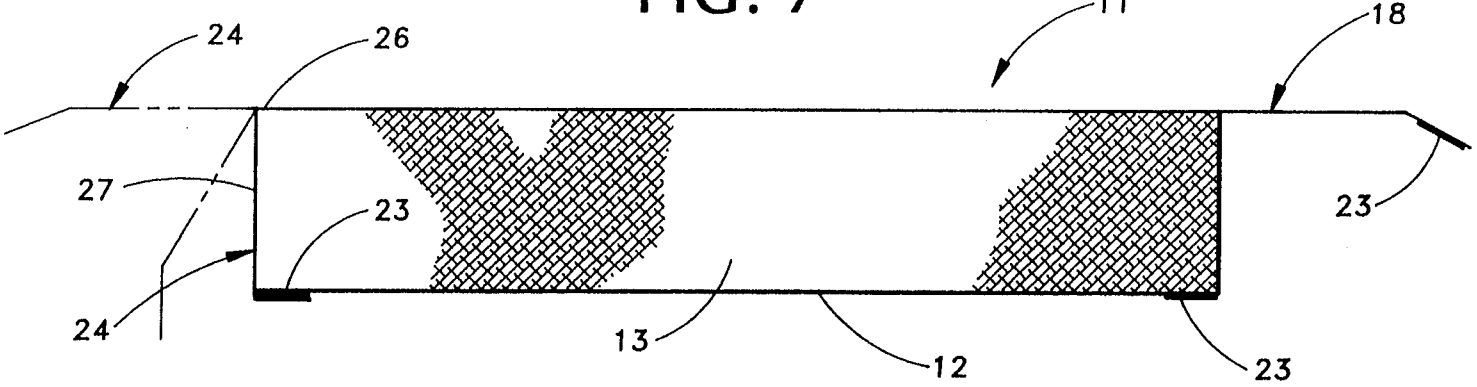
FIG. 7 is a front elevational view showing the resilient housing and showing the closing operation of the second closing flap.
Figure 8:
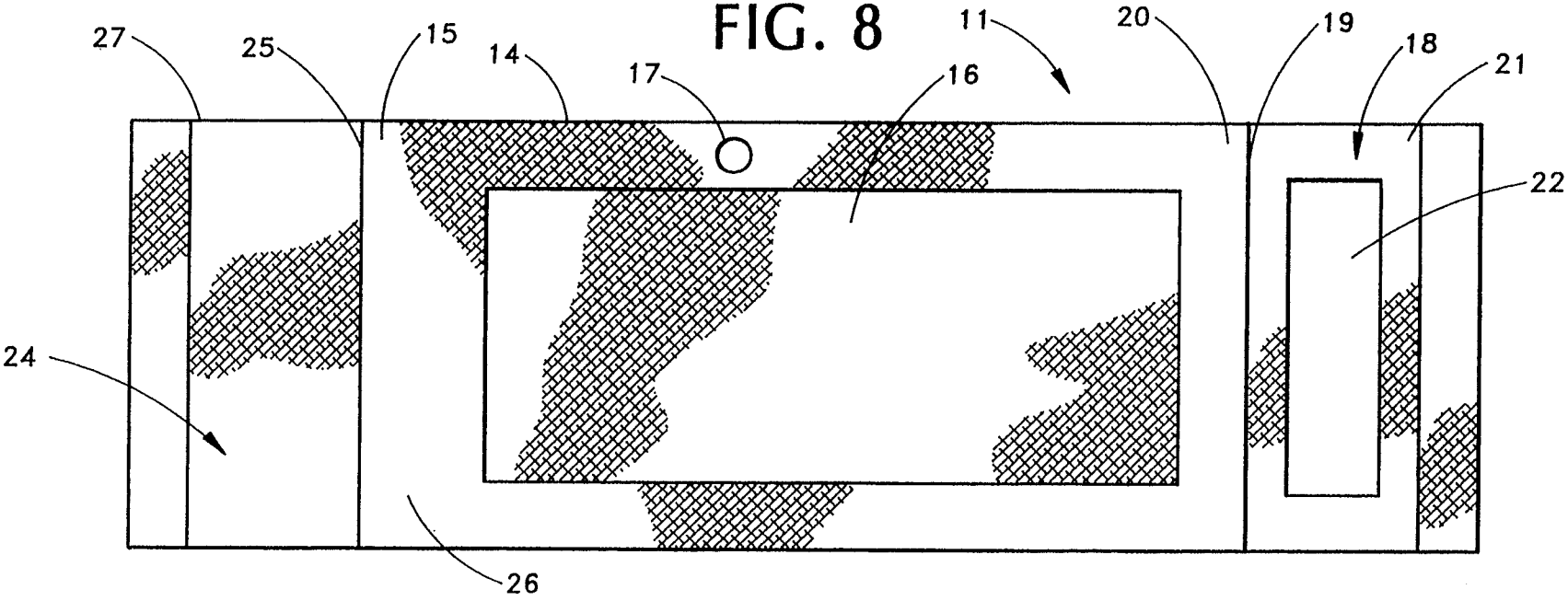
FIG. 8 is a top plan view of the resilient housing showing the first and second end flaps open and extended. The switch port and the first signal projection port are also shown.

A protective enclosure 28 is removably placed within the resilient housing 11. The protective enclosure 28 has an enclosure bottom wall 29, two upstanding enclosure side walls 30 and 31 connected to the enclosure bottom wall 29 and an enclosure top wall 32 connected to the enclosure side walls 30 and 31. The enclosure top wall 32 has a second access viewing port 33 therein. The enclosure top wall 32 also has a switch port 34 therein that provides access to the light circuit chamber 35 and allows the switch 36 to extend from the circuit chamber 35 through the enclosure top wall 32 and through the housing switch port 17 in the housing top wall 15. There is a first enclosure end wall 37 connected to the enclosure top wall 32 and the enclosure bottom wall 29. The first enclosure end wall 37 has a second signal projection port 38 therein to allow a signal such as an infrared signal, traveling to the appliance (not shown) being controlled by the remote control unit 100, to proceed unimpeded by the cover 10 for a remote control. A second enclosure end wall 39 is connected to the enclosure top wall 32 and to the enclosure bottom wall 29. There is a light circuit chamber 35 in the second enclosure end wall 39. The light circuit chamber 35 extends into one of the enclosure side walls (The wall utilized in the drawings is shown in FIG. 4 and is side wall 30). A lens port 40 extends from the light circuit chamber 35 through the enclosure side wall 30 and into a remote control unit chamber 41. The lens port 40 has a light dispersing lens 42 therein.

There is a light circuit 43 in the light circuit chamber 35 that has a power source 44 in the circuit 43. There is a light or LED 45 and a switch 36 in the circuit 43 to selectively provide power to the light 45.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

We claim:

1. A protective cover for a remote control unit, the remote control unit having pressure responsive buttons thereon and a signal generator on one end, comprising:

(a) A resilient housing comprising:

a housing bottom wall;

two upstanding housing side walls connected to the housing bottom wall;

a housing top wall connected to the housing side walls;

the housing top wall having a first access viewing port therein;

the housing top wall having a switch port therein;

a first closing flap having an integral hinged connection to one end of the housing top wall and selectively forming a first housing end wall;

the first closing flap having a first projection port therein;

the first closing flap releasably attached to the housing bottom wall by a hook and loop fastener;

a second closing flap having an integral hinged connection to another end of the housing top wall and selectively forming a second housing end wall; and the second closing flap releasably attached to the housing bottom wall by a hook and loop fastener; and (b) a protective enclosure removably placed within the resilient housing comprising:

an enclosure bottom wall;

two upstanding enclosure side walls connected to the enclosure bottom wall;

an enclosure top wall connected to the enclosure side walls;

the enclosure top wall having a second access viewing port therein;

a first enclosure end wall connected to the enclosure top wall and the enclosure bottom wall;

the first enclosure end wall having a second signal projection port therein;

a second enclosure end wall connected to the enclosure top wall and the enclosure bottom wall;

a light circuit chamber in the second enclosure end wall and extending into one of the enclosure side walls, the light circuit chamber having;

a light circuit disposed within the light circuit chamber, comprising:

a power source in the circuit; a light in the circuit; and a switch in the circuit to selectively provide power to the light.

the enclosure top wall having a switch port therein providing access to the light circuit chamber and allowing the switch to extend from the light circuit chamber, through the enclosure top wall and through the housing switch port in the housing top wall;

a lens port extending from the light circuit chamber through an enclosure side wall and into a remote control unit chamber; and the lens port having a light dispersing lens therein.

2. A protective cover for a remote control unit, the remote control unit having pressure responsive buttons thereon and a signal generator on one end, comprising:

(a) a resilient housing comprising:

a housing bottom wall;

two upstanding housing side walls connected to the housing bottom wall;

a housing top wall connected to the housing side walls;

the housing top wall having a first access viewing port therein;

the housing top wall having a switch port therein;

a first closing flap having an integral hinged connection to one end of the housing top wall and selectively forming a first housing end wall;

the first closing flap releasably attached to the housing bottom wall by a hook and loop fastener;

a second closing flap having an integral hinged connection to another end of the housing top wall and selectively forming a second housing end wall; and the second closing flap releasably attached to the housing bottom wall by a hook and loop fastener;

(b) a protective enclosure removably placed within the resilient housing;

(c) a light circuit chamber in the protective enclosure; and (d) a light circuit in the light circuit chamber.

3. A protective cover for a remote control unit as described in claim 2 wherein the light circuit further comprises:

(a) a power source in the circuit;

(b) a light in the circuit; and (c) a switch in the circuit to selectively provide power to the light.

4. A protective cover for a remote control unit as described in claim 2 wherein the light circuit chamber further comprises:

(a) a lens port extending from the light circuit chamber through an enclosure side wall and into a remote control unit chamber; and (b) the lens port having a light dispersing lens therein;

* * * * *